US010427699B2

(12) United States Patent
Haedicke et al.

(10) Patent No.: US 10,427,699 B2
(45) Date of Patent: Oct. 1, 2019

(54) INFORMATION TRANSMISSION SYSTEM AND INFORMATION TRANSMISSION METHOD FOR RAIL TRANSPORT

(71) Applicant: SIEMENS MOBILITY GMBH, Munich (DE)

(72) Inventors: Florian Haedicke, Braunschweig (DE); Uwe Rosenkranz, Braunschweig (DE)

(73) Assignee: Siemens Mobility AG, Munich (DE)

( * ) Notice: Subject to any disclaimer, the term of this patent is extended or adjusted under 35 U.S.C. 154(b) by 464 days.

(21) Appl. No.: 15/109,142

(22) PCT Filed: Jan. 5, 2015

(86) PCT No.: PCT/EP2015/050024
§ 371 (c)(1),
(2) Date: Jun. 30, 2016

(87) PCT Pub. No.: WO2015/104231
PCT Pub. Date: Jul. 16, 2015

(65) Prior Publication Data

US 2016/0325765 A1 Nov. 10, 2016

(30) Foreign Application Priority Data

Jan. 7, 2014 (DE) ..... 10 2014 200 059

(51) Int. Cl.

| | |
|---|---|
| ***B61L 3/12*** | (2006.01) |
| ***B61L 15/00*** | (2006.01) |
| ***B61L 29/00*** | (2006.01) |
| ***B61L 1/02*** | (2006.01) |

(Continued)

(52) U.S. Cl.
CPC ..... *B61L 3/12* (2013.01); *B61L 1/02* (2013.01); *B61L 7/00* (2013.01); *B61L 13/00* (2013.01); *B61L 15/0027* (2013.01); *B61L 29/00* (2013.01)

(58) Field of Classification Search
CPC ..... B61L 11/08; B61L 15/0027; B61L 3/125; B61L 13/00
See application file for complete search history.

(56) References Cited

U.S. PATENT DOCUMENTS 5,036,478 A * 7/1991 MacDougall ..... B61L 1/14 246/122 R
5,420,883 A * 5/1995 Swensen ..... B61L 3/125 342/450

(Continued)

FOREIGN PATENT DOCUMENTS

DE 3915466 A1 12/1989
DE 202008003947 U1 7/2008

(Continued)

*Primary Examiner* — Zachary L Kuhfuss
(74) *Attorney, Agent, or Firm* — Laurence Greenberg; Werner Stemer; Ralph Locher

(57) ABSTRACT

An economical information transmission system for rail transport includes a transmitter having a known transmission power for communication between a track section and a rail vehicle. A receiver has at least one first adjustable receive level threshold, with which a maximum distance between the transmitter and the receiver can be defined in a particular application, within which the receiver is able to receive with respect to the transmitter. An information transmission method is also provided.

22 Claims, 2 Drawing Sheets

(51) Int. Cl.
*B61L 7/00* (2006.01)
*B61L 13/00* (2006.01)

(56) References Cited

U.S. PATENT DOCUMENTS

| | | | | |
|---|---|---|---|---|
| 2010/0191395 | A1* | 7/2010 | Rosenkranz | B61L 3/125 701/19 |
| 2011/0222426 | A1* | 9/2011 | Chazel | B61L 15/0027 370/252 |
| 2012/0037761 | A1* | 2/2012 | Bock | B61L 7/06 246/125 |
| 2013/0325211 | A1* | 12/2013 | El Fassi | B61L 11/08 701/2 |
| 2015/0008293 | A1* | 1/2015 | Hatazaki | B61L 27/0038 246/30 |
| 2015/0142225 | A1* | 5/2015 | Tonguz | B61L 19/06 701/19 |
| 2016/0325765 | A1* | 11/2016 | Haedicke | B61L 3/12 |

FOREIGN PATENT DOCUMENTS

| | | | |
|---|---|---|---|
| DE | 102007060757 | A1 | 7/2009 |
| FR | 2493567 | A1 | 5/1982 |
| WO | 0247955 | A1 | 6/2002 |
| WO | 2008031523 | A1 | 3/2008 |

* cited by examiner

INFORMATION TRANSMISSION SYSTEM AND INFORMATION TRANSMISSION METHOD FOR RAIL TRANSPORT

BACKGROUND OF THE INVENTION

Field of the Invention

A number of information transmission systems for rail transport are known in which information is transmitted between rail vehicle and track.

A known information transmission system is in operation as Siemens Trainguard IMU 100. Here a transmitter is communicatively connected to a receiver by way of inductive coupling of two coils or of a coil and a track conductor. The known system operates at a frequency of 850 kHz and has a range of less than a meter. This obviates the need for addressing between transmitter and receiver, because commands are then only executed trackside when the rail vehicle is in the receiver's locally very limited receive range. At each location in which a rail vehicle is to trigger a switching operation, a coil or a track conductor loop together with feeder cable must be laid to a controller on the line or in the track surface.

Another known information transmission system is designed for receiver addressing. Here the location-related receiver addresses must be known to the transmitter carried on the rail vehicle, e.g. by using a route map on board. The transmitter must also know its respective own location in order to be able to address the nearest receiver only in a particular area and using the correct address. The known information transmission system is therefore relatively complex/costly.

BRIEF SUMMARY OF THE INVENTION

The object of the present invention is to propose an information transmission system which is not only future-proof but also inexpensive.

This object is inventively achieved by an information transmission system having track-to-train communication whereby a transmitter having a known transmit power is provided and a receiver having at least one first adjustable receive level threshold is present by means of which, in the respective application, a maximum distance between transmitter and receiver can be defined within which the receiver is able to receive with respect to the transmitter.

An important advantage of the information transmission system according to the invention consists in that, compared to an information transmission system using inductive coupling, it only requires a receiver whose antenna can be mounted on a mast outside the track bed, for example. A plurality of coils or conductor loops is not required; long supply cables are also unnecessary.

Compared to the known information transmission system using receiver addressing, no position or distance knowledge in the form of route tables is required.

In addition, with the system according to the invention it also advantageously suffices to use solely an independent on-board communication device connected solely to a supply voltage.

With the information transmission system according to the invention, the maximum distance between transmitter and receiver can be determined in different ways in the case of the first receive threshold selected for the receiver. For example, trial runs with measurements can be carried out.

However, for practicability reasons it is already regarded as particularly advantageous if, for specifying a minimum distance between transmitter and receiver ensuring reliable reception, the maximum distance is given by the relation dmax=dmin*2^(As/6 dB) where As denotes the maximum likely receive level attenuation in dB in addition to the free space loss over the minimum distance. In the context of the invention it has actually been found that this relation allows the maximum distance to be computed in a simple and sufficiently accurate manner.

With the information transmission system according to the invention, the transmitter and receiver can be interchangeably disposed on the track and rail vehicle. It appears advantageous to position the transmitter on the track and mount the receiver on the rail vehicle. This makes it advantageously possible to connect the receiver to a route and/or destination indicating device in the rail vehicle so that information concerning location beacons, updates of timetable information can be transmitted and PA announcements can be triggered in the rail vehicle.

In a preferred embodiment of the information transmission system according to the invention, the receiver is disposed on the track and the transmitter is on board the rail vehicle. This opens up the advantageous possibility of assigning the receiver adjacently to a control device for at least one fixed rail transport installation.

Different rail transport installations can be linked into the information transmission system according to the invention; it is considered particularly advantageous if the rail transport installation is a signaling installation, a switch or a circuit arrangement for a grade crossing.

With the information transmission system according to the invention, the transmitter and the receiver can have different characteristics. If a spherical characteristic is selected, it is then possible, in the case of rail transport installations having a spacing corresponding to the maximum distance, for the control devices of both rail transport installations to be acted upon simultaneously by a transmitter-carrying rail vehicle moving between the two rail transport installations.

If this is undesirable for safety reasons, for example, it is then advantageous for the antenna of the transmitter and/or that of the receiver to have a directional characteristic dependent on the direction of travel of the rail vehicle. In this case the different rail transport installations can be spaced almost at the maximum distance, i.e. follow one another at relatively small intervals along the track.

Particularly if the receiver of the information transmission system according to the invention is adjacently assigned to a control device of a fixed rail transport installation, it is considered advantageous for the receiver to be designed such that, if the first receive level threshold is exceeded, it issues a warning signal and if a second, higher receive level threshold is exceeded, it generates a train approaching signal.

It also appears advantageous to design the receiver such that, if a receive level threshold midway between the first and the second receive level threshold is undershot for a longer period than a predefined train receding detection period, it produces a train receding signal.

Another feature advantageously contributing to the reliable operation of rail traffic using the information transmission system according to the invention is that the receiver is designed such that, during a train receding period beginning after expiration of the train receding detection period and lasting longer than this period, it ignores receive signals from the transmitter.

Instead of using the information transmission system according to the invention to monitor the train receding period, it can advantageously also be provided that the receiver is assigned a transmit device such that it receives the train receding signal of the receiver and then sends out an identifier signal which is characteristic of the actuating device just left; the transmitter is assigned a receive device such that it uses the received identifier signal to cause the transmitter to produce signals having a marking which is interpreted by the receiver as an ignore command. Bidirectional radio transmission which can be inexpensively implemented using transceivers therefore takes place here.

The invention also relates to an information transmission method for rail transport using track-to-train communication, the purpose of which is to make the information transmission system not only future-proof but also cost-effective.

In the information transmission method according to the invention, this object is achieved by a transmitter having a known transmit power and a receiver having a least one first adjustable receive level threshold, and, by adjusting the receive level threshold in the respective application, a maximum distance between transmitter and receiver is defined within which it is possible for the receiver to receive with respect to the transmitter.

The information transmission method according to the invention has in turn the same advantages as those stated above in connection with the information transmission system according to the invention.

With the transmission method according to the invention, the maximum distance between transmitter and receiver for the receiver's first receive threshold can be determined in different ways. For example, trial runs with measurements can be carried out for this purpose.

To reduce cost/complexity in this respect, with the information transmission method according to the invention a minimum distance between transmitter and receiver ensuring reliable reception is advantageously predefined, and the maximum distance is calculated by means of the relation $$d\max = d\min * 2^{\wedge}(As/6\ \mathrm{dB}),$$

where As is the maximum likely receive level attenuation in dB over the minimum distance in addition to the free space loss.

In the information transmission method according to the invention, the transmitter and receiver can be interchangeably disposed on the track and rail vehicle. It is advantageous if the information transmission method according to the invention is operated with the transmitter on the track and the receiver on the rail vehicle. The receiver can then transmit information to a route and/or destination indicating device on the rail vehicle.

However, it is also particularly advantageous if the information transmission method according to the invention is operated with the receiver on the track and the transmitter on the rail vehicle. In this case the receiver can advantageously transmit information to an adjacent control device for at least one fixed rail transport installation.

Different rail transport installations can be used with the information transmission method according to the invention. The rail transport installation used can advantageously be a signaling installation, a switch or a grade crossing, thereby enabling most requirements to be covered.

The information transmission method according to the invention can basically be operated using antennas having very different characteristics, including antennas having a spherical characteristic. As described above in connection with the information transmission system according to the invention, there are particular advantages if an antenna having a directional characteristic dependent on the direction of travel of the rail vehicle is used as the antenna of the transmitter and/or of the receiver.

Advantageously with the information transmission method according to the invention, if the first receive level threshold is exceeded, a warning signal is generated and, if a second, higher receive level threshold is exceeded, a train approaching signal is generated; this allows safe operation of, among other things, a rail transport installation implemented as a grade crossing.

In the same context, if a receive level threshold midway between the first and the second receive level threshold is undershot for a longer period of time than a predefined train receding detection period, it is advantageous to generate a train receding signal.

In order, among other things, not to occupy the respective rail transport installation for longer than necessary, with the information transmission method according to the invention signals from the transmitter remain disregarded during a train receding period beginning when the train receding detection period has elapsed and longer than this time.

Alternatively, with the information transmission method according to the invention it can also be provided that, in response to a train receding signal of the receiver, a transmit device assigned to the receiver transmits an identifier signal which is characteristic of the control device just left;

In response to the received identifier signal, a receive device assigned to the transmitter causes the transmitter to emit signals having a marking which is interpreted by the receiver as an ignore command.

DESCRIPTION OF THE INVENTION

Figure 1:
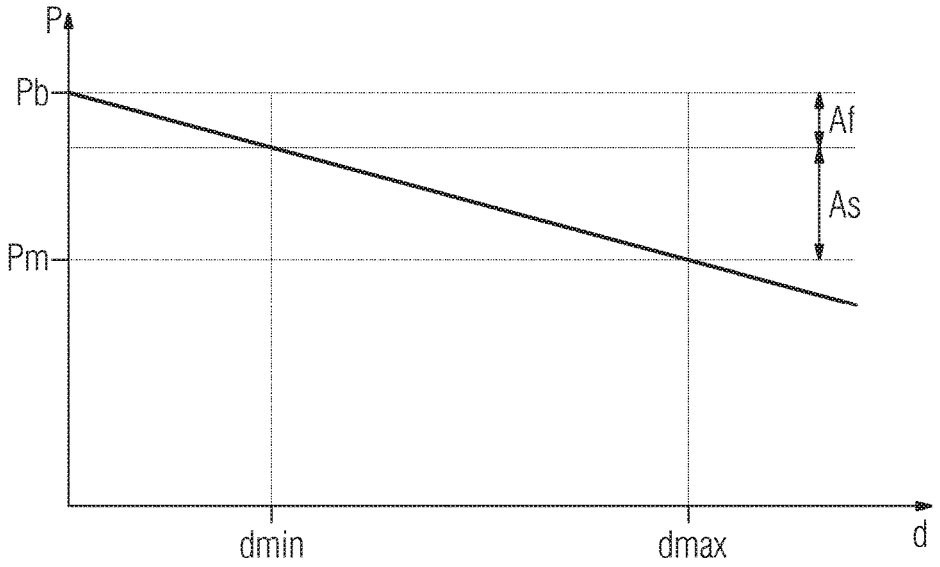
FIG. 1 shows a graph illustrating the basic mode of operation of the information transmission system/method according to the invention.

In the graph according to FIG. 1, the measurable power P of a transmitter of an information transmission system is plotted against the distance d from the transmitter. It is assumed that the transmitter is located at d=0. Here the maximum power is measurable which, in the context of the information transmission system, is predefined as known quantity Pb. Also pre-selected is a minimum distance dmin within which information can be transmitted from the transmitter to the receiver taking all likely level attenuations into account. The level attenuations to be taken into account are the free space loss Af over the minimum distance dmin and all the likely maximum receive level attenuations As over the minimum distance, such a weather effects, antenna contamination, aging of the transmission components, etc. This results in a minimum receive level threshold Pm according to the following relation:

$$Pm = Pb - Af - As$$

So long as the receive level at the receiver is not lower than Pm, the receiver will be able to process received information.

From the minimum distance dmin and the maximum likely receive level attenuations As, a maximum distance dmax can be calculated according to the approximation formula $$dmax=dmin*2^{(As/6\ dB)};$$

this formula is only valid if it is assumed that, apart from the free space loss Af, no other level attenuations occur up to the maximum effective distance. The maximum distance dmax thus denotes the smallest required distance of the receiver from the transmitter so that information from the transmitter can be acquired by the receiver.

The minimum distance dmin is therefore the distance over which information transmission operates reliably even allowing for all conceivable external influences. The maximum distance dmax is the distance over which receive levels above the receive level threshold Pm are likely.

The above remarks indicate that—if it to be ensured that the receive threshold of the receiver is always exceeded and therefore that data received at a particular location is always processed—the transmitter and receiver at that location need only be spaced the minimum distance apart. If it is to be ensured that the level Pm is always undershot at a particular location, the transmitter and receiver must be spaced at least the maximum distance dmax apart.

In a specific implementation of the information transmission system, a transmitter having a known transmit power Pb of 10 dBm was selected on the basis of the constraints and characteristics according to an IEEE standard and a minimum distance dmin of 2 m was predefined. A free space loss of 46.1 dB and a maximum likely receive level attenuation As produced a receive level threshold Pm of −56.1 dBm, resulting in a maximum distance of 20.2 m between transmitter and nearest receiver. If a transmitter is here used on a moving rail vehicle and the transmitter's antenna has a pronounced directional characteristic in the direction of travel, an upstream receiver can then be disposed relatively close before the distance of 20.2 m from a receiver without simultaneous influencing of both receivers being able to occur.

Therefore, the smaller the maximum distance dmax, the more independently addressable the receivers that can be installed on a section of track. The maximum distance dmax can then be reduced by selecting the minimum distance dmin as small as possible and minimizing the likely receive level attenuations As.

Figure 2:
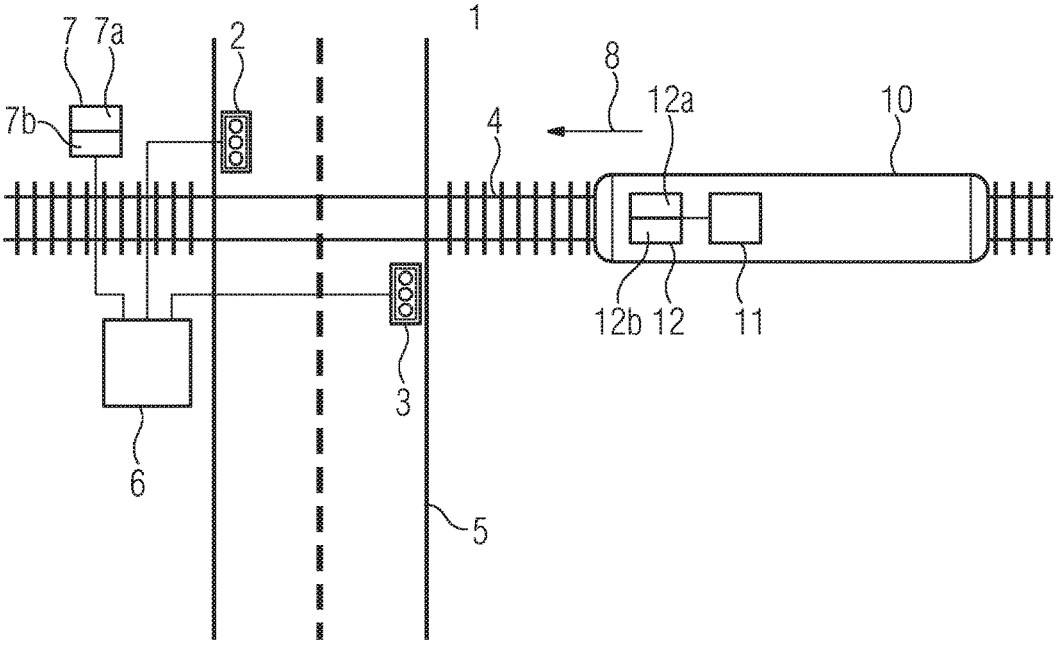
FIG. 2 shows an exemplary embodiment of the information transmission system/method according to the invention in the case of an automatic light signal system at a grade crossing.

FIG. 2 shows a rail transport installation in the form of a grade crossing 1 having an automatic light signal system comprising two color light signals 2 and 3 between which a line 4 of a section of track (not shown in greater detail) crosses a road 5. The color light signals 2 and 3 are connected to a control device 6 of the automatic light signal system. Also connected to the control device 6 is a receiver 7*a* which, in the example shown, is part of a transceiver 7.

As FIG. 2 also shows, a rail vehicle 10 equipped with a control unit 11 and moving in the direction the arrow 8 is approaching the light signal system. Connected to the control unit 11 is a transmitter 12*a* which is implemented by means of a transceiver 12.

Prior to its approach to the light signal system, the rail vehicle 10 or rather its transmitter 12*a* cyclically transmits a data telegram containing information concerning the rail vehicle's identity. The rail vehicle 10 is not within range, i.e. the maximum distance dmax, of the receiver 7*a* of the transceiver 7, so that the color light signals 2 and 3 are on green.

Figure 3:
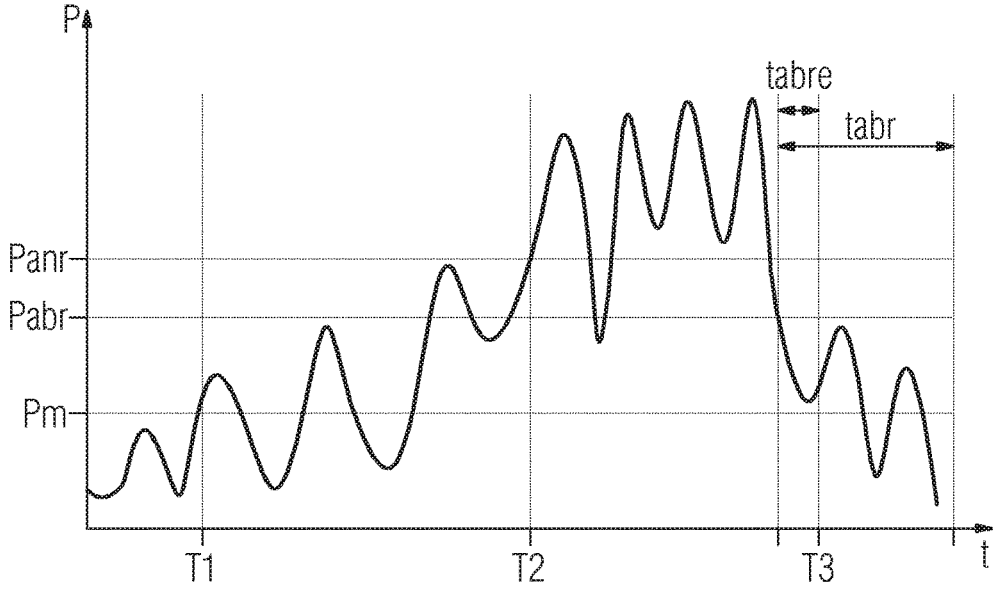
FIG. 3 shows another graph illustrating the mode of operation of the exemplary embodiment.

If the rail vehicle 10 comes within range of the receiver 7*a* of the transceiver 7, i.e. the distance of the rail vehicle 10 from the receiver 7*a* is less than the maximum distance dmax, the (first) receive level threshold Pm (cf. FIG. 1) is exceeded for the first time at time T1 (see FIG. 3); the control device 7 is acted on by the receiver 7*a* of the transceiver 7 and generates the information "train approaching". The color light signals 2 and 3 remain on green.

When the rail vehicle 10 is close enough to the light signal system that a second, higher receive level threshold Panr is exceeded, at this point in time T2 (cf. FIG. 3) a train approaching signal Sanr is generated which causes the control device 6, to switch the color light signals 2 and 3 to red.

If the rail vehicle 10 is in the area of the automatic light signal system, it is continuously checked whether a receive level threshold Pabr midway between the receive level threshold Pm and the second receive level threshold Panr is undershot for a longer period than a predefined train receding detection period tabre. If this is the case—in this example at time T3—the color light signals 2 and 3 change to green.

With the beginning of the train receding detection period tabre, a train receding period tabr is started and ensures that the receiver 7*a* of the transceiver 7 ignores the possibly still being received data telegrams of the transmitter 12*a* on the rail vehicle 10 which contain the rail vehicle's identity, so that the color light signals 2 and 3 remain set to green in the desired manner.

The exemplary embodiment shown, comprising two transceivers 7 and 12, offers the possibility of incorporating the transmit device 7*b* of the transceiver 7 and the receive device 12*b* of the transceiver 12 in the transmission system by the transmit device 7*b* of the transceiver 7 receiving the train receding signal Sabr of the receiver 7*a* of said transceivers 7 and then generating an identifier signal. This signal is typical of the automatic light signal system just left and is transmitted to the receive device 12*b* of the transceiver 12. This means that the transmitter 12*a* of this transceiver is controlled such that it emits signals having a marking which is interpreted by the receiver 7*a* of the transceiver 7 as ignore commands. The color light signals 2 and 3 then remain on green.

The invention claimed is:

1. An information transmission system for rail transport using communication between a track and a rail vehicle, the system comprising:

a transmitter having a known transmit power; and a receiver having at least one first adjustable receive level threshold defining a maximum distance between said transmitter and said receiver within which said receiver can receive with respect to said transmitter in a respective application;

a second receive level threshold being higher than said at least one first adjustable receive level threshold;

said receiver producing a warning signal if said at least one first adjustable receive level threshold is exceeded and generating a train approaching signal if said second receive level threshold is exceeded.

2. The information transmission system according to claim 1, wherein a minimum distance between said transmitter and said receiver ensuring reliable reception is predefined by determining the maximum distance using a relation:

$$dmax=dmin*2^{(A/6\ dB)},$$

where A denotes a maximum likely receive level attenuation in dB in addition to free space loss over the minimum distance.

3. The information transmission system according to claim 1, wherein said transmitter is positioned on the track and said receiver is mounted on the rail vehicle.

4. The information transmission system according to claim 3, which further comprises at least one of a route or destination indicating device disposed on the rail vehicle and connected to said receiver.

5. The information transmission system according to claim 1, wherein said receiver is disposed on the track and said transmitter is disposed on the rail vehicle.

6. The information transmission system according to claim 5, which further comprises a control device for at least one fixed rail transport installation, said receiver being disposed adjacent said control device.

7. The information transmission system according to claim 6, wherein the rail transport installation is a signaling installation, a switch or a grade crossing.

8. The information transmission system according to claim 1, wherein at least one of said transmitter or said receiver has an antenna with a directional characteristic dependent on a direction of travel of the rail vehicle.

9. The information transmission system according to claim 1, wherein said receiver produces a train receding signal if a receive level threshold midway between said at least one first adjustable receive level threshold and said second receive level threshold is undershot for a longer period of time than a predefined train receding detection period.

10. The information transmission system according to claim 9, wherein said receiver ignores receive signals from said transmitter during a train receding period beginning with a start of the train receding detection period and lasting longer than the train receding detection period.

11. The information transmission system according to claim 9, which further comprises:

a transmit device associated with said receiver, said transmit device receiving the train receding signal of said receiver and transmitting an identifier signal being characteristic of the rail transport installation just left; and a receive device associated with said transmitter, said receive device using the received identifier signal to cause said transmitter to produce signals having a marking being interpreted by said receiver as an ignore command.

12. An information transmission method for rail transport using communication between a track and a rail vehicle, the method comprising the following steps:

providing a transmitter having a known transmit power and a receiver having at least one first adjustable receive level threshold; and adjusting the at least one first adjustable receive level threshold in a particular application to define a maximum distance between the transmitter and the receiver within which the receiver is able to receive with respect to the transmitter; and generating a warning signal if the at least one first adjustable receive level threshold is exceeded, and generating a train approaching signal if a second receive level threshold being higher than the at least one first adjustable receive level threshold is exceeded.

13. The information transmission method according to claim 12, which further comprises:

predefining a minimum distance between the transmitter and the receiver ensuring reliable reception; and calculating the maximum distance using a relation:

$$d\max = d\min * 2\hat{}(As/6\ \text{dB}),$$

where As is a maximum likely receive level attenuation in dB in addition to free space loss over the minimum distance.

14. The information transmission method according to claim 12, wherein the transmitter is on the track and the receiver is on the rail vehicle.

15. The information transmission method according to claim 14, which further comprises using the receiver to transmit information to at least one of a route or destination indicating device on the rail vehicle.

16. The information transmission method according to claim 12, wherein the receiver is on the track and the transmitter is on the rail vehicle.

17. The information transmission method according to claim 16, which further comprises using the receiver to transmit information to an adjacent control device for at least one adjacent rail transport installation.

18. The information transmission method according to claim 17, which further comprises providing a signaling installation, a switch or a grade crossing as the rail transport installation.

19. The information transmission method according to claim 12, which further comprises providing at least one of the transmitter or the receiver with an antenna having a directional characteristic dependent on a direction of travel of the rail vehicle.

20. The information transmission method according to claim 12, which further comprises generating a train receding signal if a receive level threshold midway between the at least one first adjustable receive level threshold and the second receive level threshold is undershot for a longer period of time than a predefined train receding detection period.

21. The information transmission method according to claim 20, which further comprises disregarding signals from the transmitter during a train receding period beginning when the train receding detection period has elapsed and lasting longer than the train receding detection period.

22. The information transmission method according to claim 20, which further comprises:

using a transmit device associated with the receiver, in response to the train receding signal of the receiver, to transmit an identifier signal being characteristic of a rail transport installation just being left; and using a receive device associated with the transmitter to cause the transmitter, in response to the received identifier signal, to emit signals having a marking being interpreted by the receiver as ignore commands.

* * * * *